United States Patent [19]

Pratt et al.

[11] 4,013,182

[45] Mar. 22, 1977

[54] DETACHABLE COUPLING SYSTEM

[75] Inventors: Samuel S. Pratt, Core, W. Va.; Peter N. Lalos, Gaithersburg, Md.

[73] Assignee: Rockland, Inc., Wintergarden, Fla.

[22] Filed: Apr. 21, 1975

[21] Appl. No.: 569,684

[52] U.S. Cl. ..... 214/145 A; 172/272

[51] Int. Cl.[2] ..... E02F 3/81

[58] Field of Search ..... 214/145 A; 172/272; 24/243 FM

[56] References Cited

UNITED STATES PATENTS

| | | | |
|---|---|---|---|
| 3,760,883 | 9/1973 | Birk | 214/145 A |
| 3,794,195 | 2/1974 | Clevenger et al. | 214/145 A |
| 3,818,551 | 6/1974 | Coughran, Jr. | 214/145 A |
| 3,935,953 | 2/1976 | Stedman | 214/145 A |

FOREIGN PATENTS OR APPLICATIONS

| | | | |
|---|---|---|---|
| 1,457,680 | 5/1969 | Germany | 172/272 |

*Primary Examiner*—L. J. Paperner
*Assistant Examiner*—Ross Weaver
*Attorney, Agent, or Firm*—Mason, Fenwick & Lawrence

[57] ABSTRACT

A system for detachably coupling an attachment to a prime mover provided with a mounting means and an actuating means generally comprising a female device mountable on the attachment and a collapsible male assembly mountable on the mounting means of the prime mover, cooperatively engageable with the female device, the male assembly being operatively connectible to the actuating means and movable thereby between a collapsed, inoperative condition and an extended, operative condition operatively engageable with the female device in coupling relation therewith when the male assembly is positioned adjacent the female device in registry therewith, and means mounted on the male assembly for selectively locking the male assembly in the extended, operative condition.

15 Claims, 6 Drawing Figures

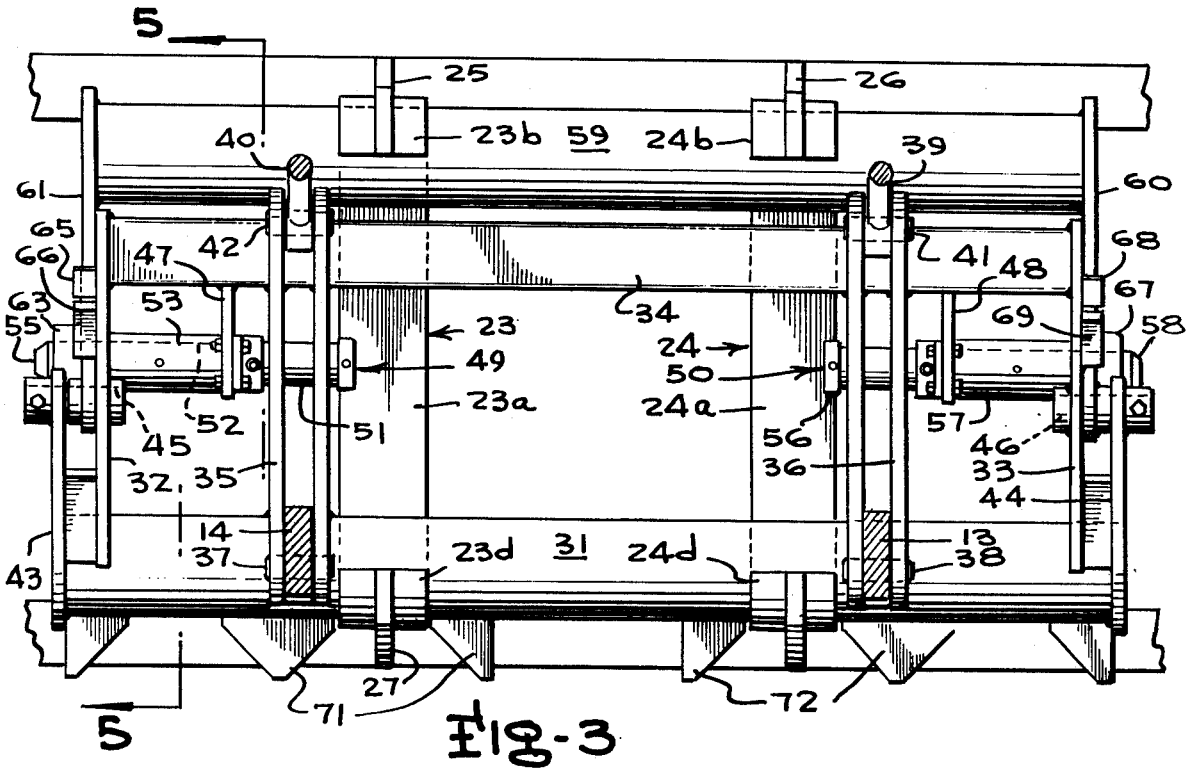
Fig-3
Fig-2
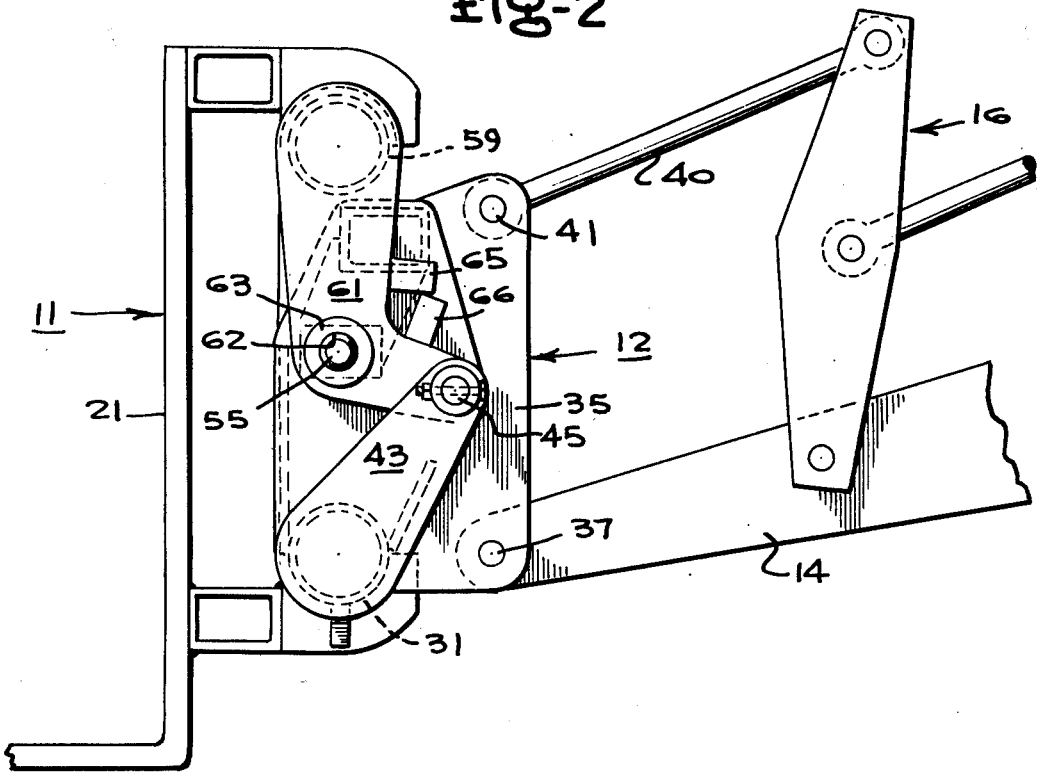

DETACHABLE COUPLING SYSTEM

This invention relates to a coupler system and more particularly to a system for detachably coupling a working attachment such as a bucket, blade, fork and the like to a prime mover such as a front end loader.

Generally, most front end loaders in the prior art are provided with a pair of forwardly projecting boom arms which are pivotally connected at the rear ends thereof to the loader, means disposed at the forward ends of the boom arms for detachably connecting a working attachment such as a bucket, a blade, a fork, and the like to the boom arms, and fluid actuated piston and cylinder assemblies for pivoting the boom arms to lift and lower an attachment connected thereto. Such loaders also generally are provided with dump or tilt linkages which are mounted on the boom arms, operatively connected at the front ends thereof to a working attachment connected on the boom arms and are operatively connected at the rearward ends thereof to the loader by means of fluid actuated piston and cylinder assemblies which may be operated to actuate the linkages and pivot or tilt the working attachment relative to the boom arms.

It has been the common practice in the prior art to attach working attachments to the boom arms and dump or tilt linkages of front end loaders by the use of conventional pin arrangements. It further has been found, however, that such practice is inefficient whenever the operation of a front end loader requires the use of the various working attachments and frequent changes in such working attachments within short periods of time.

As a result of the inefficiencies attendant to the use of pin connections for attaching working attachments to front end loaders, there has been developed in the prior art various systems for detachably coupling working attachments on front end loaders which generally have consisted of a male assembly mounted on the boom arms of a front end loader and operatively engageable with a standard female coupling device mounted on a number of different working attachments. Normally, such systems operate in a manner whereby upon operation of the loader and the boom arms thereof, the male member of the coupling system may be positioned adjacent the female coupling device disposed on a working attachment, and the dump or tilt linkages can be operated to manipulate the male coupling member into coupled relation with the female coupling device, whereupon additional mechanisms can be employed to lock the male coupling device in coupling relation with the female coupling device.

Detachable coupling systems of the prior art, however, have been found not to be satisfactory from the standpoint of economy, performance and reliability. It thus has been found to be desirable to provide an improved system for detachably coupling working attachments such as buckets, blades, forks and the like to prime movers such as front end loaders and the like.

Accordingly, it is the principal object of the present invention to provide a novel coupler system.

Another object of the present invention is to provide a novel system for detachably coupling a working attachment such as a bucket, blade, fork and the like, to a prime mover such as a front end loader.

A further object of the present invention is to provide a novel system for detachably coupling a working attachment on a front end loader provided with a pair of forwardly projecting boom arms and dump or tilt linkages.

A still further object of the present invention is to provide a novel system for detachably coupling a working attachment to a front end loader provided with a pair of forwardly projecting boom arms and conventional dump or tilt linkages wherein such linkages may be employed to conveniently operate such system to quickly and effectively attach or detach the working attachment relative to the front end loader.

Another object of the present invention is to provide a novel system for detachably coupling a working attachment on a prime mover such as a front end loader which is comparatively simple in construction, relatively inexpensive to manufacture, simple to operate and reliable in performance.

A further object of the present invention is to provide a novel apparatus mountable on a prime mover such as a front end loader and movable by an actuating means provided on such prime mover which may be manipulated into coupling relation with a female device provided on a working attachment to detachably couple such working attachment to the prime mover.

Other objects and advantages of the present invention will become more apparent to those persons having ordinary skill in the art to which the present invention pertains, from the following description taken in conjunction with the accompanying drawings wherein:

FIG. 2 is an enlarged, side elevational view of the embodiment illustrated in FIG. 1, illustrating the major components thereof in coupled relation;

FIG. 3 is a rear elevational view of the components illustrated in FIG. 2;

Figure 1:
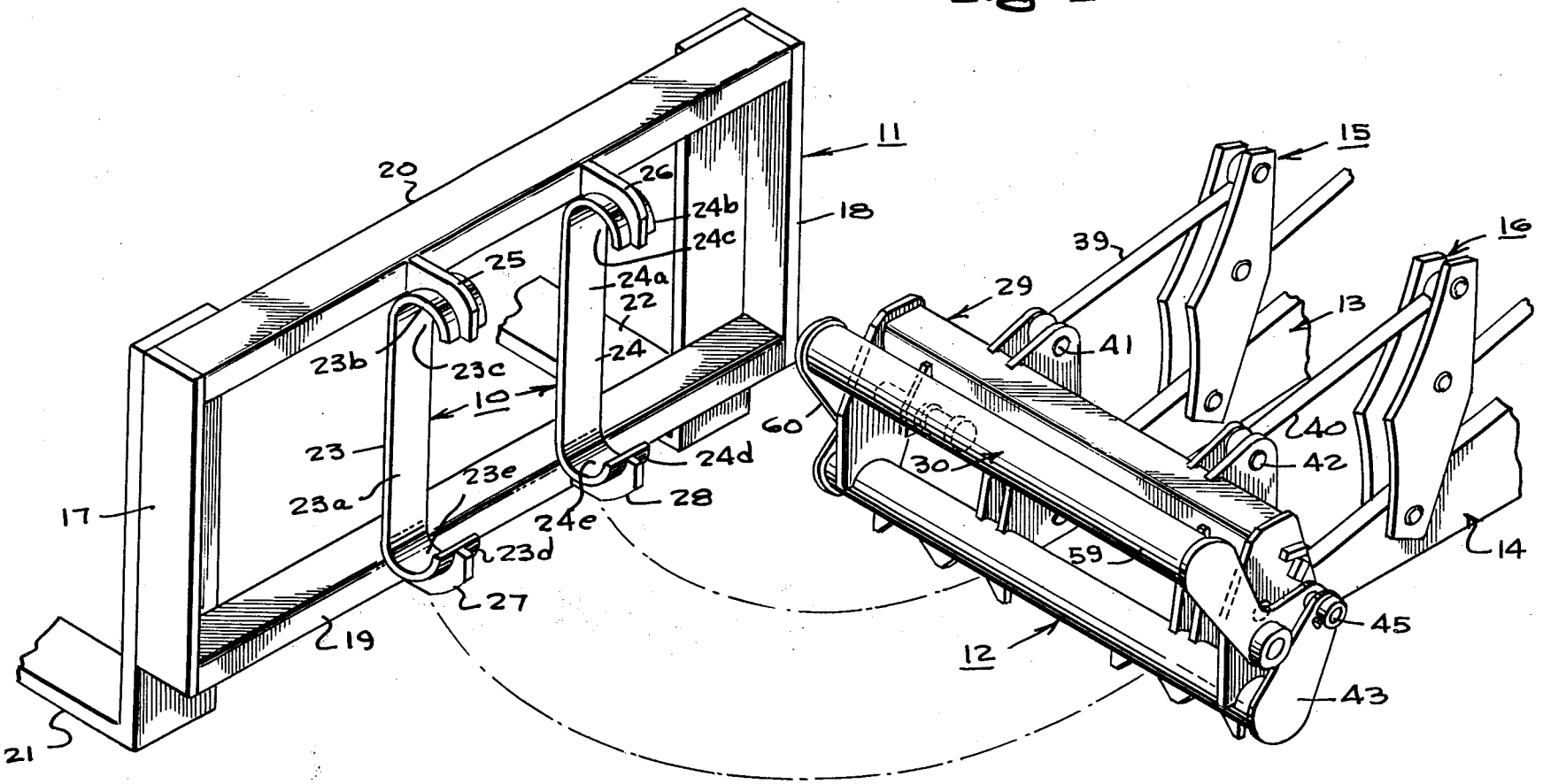
FIG. 1 is a perspective view of an embodiment of the invention, illustrating the major components thereof in detached, spaced relation.
Figure 5:
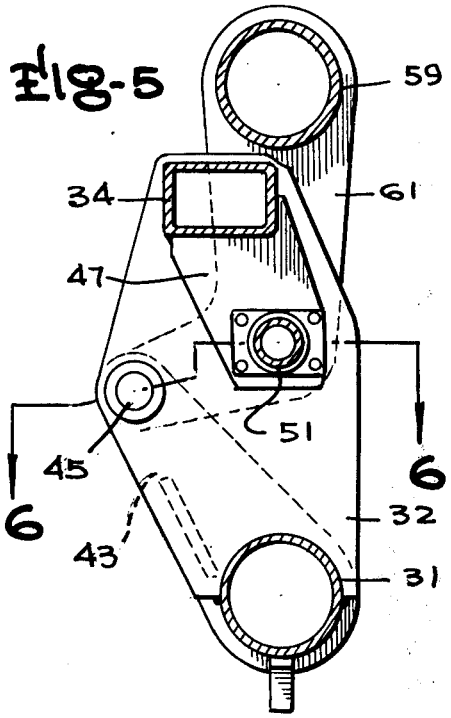
FIG. 5 is a cross-sectional view taken along line 5—5 in FIG. 3.

Referring to the drawings, there is illustrated an embodiment of the invention generally including a female assembly 10 rigidly mounted on a working attachment 11 and a collapsible male assembly 12 pivotally connected at a lower end thereof to the front end of a pair of boom arms 13 and 14 of a front end loader, operatively connected at an upper end thereof to a pair of dump or tilt linkages 15 and 16 and operatively engageable with female assembly 10 to detachably couple working attachment 11 to the front end loader on which the collapsible male assembly is mounted. Attachment 11 consists of a standard fork implement and includes a pair of transversely spaced, side members 17 and 18, a transversely disposed, lower member 19 rigidly interconnecting the lower ends of side members 17 and 18, and a transversely disposed, upper member 20 interconnecting the upper ends of side members 17 and 18, forming a base frame, and a pair of L-shaped members 21 and 22, each having a vertical portion rigidly secured on the front side of the base frame, and a forwardly projecting tine portion. Although attachment 11 is illustrated in the drawings and described herein as a fork implement, it is to be understood that such attachment may consist of a variety of implements mountable on front end loaders, including a general purpose bucket, a boom, a backhoe, a snowplow, a lift mast, a snow blower, a blade, a vibrating roller, a land clearing implement, a specialized bucket and other specialized tools.

Female assembly 10 consists of a pair of rearwardly opening, transversely spaced and aligned C-shaped members 23 and 24, rigidly secured in vertical positions on the rear side of attachment 11 by means of a pair of upwardly disposed, rearwardly projecting brackets 25 and 26 and a pair of downwardly disposed, rearwardly projecting brackets 27 and 28. C-shaped member 23 includes an intermediate, vertical portion 23*a* disposed in alignment with a similar portion 24*a* of C-shaped member 24, an upper, downwardly opening hook portion 23*b* disposed in transverse alignment with a similar portion 24*b* of C-shaped member 24, providing a pair of transversely aligned recesses 23*c* and 24*c*, and a lower, upwardly opening hook portion 23*d* disposed in tranverse alignment with a similar hook portion 24*d* of C-shaped member 24, providing a pair of transversely aligned recesses 23*e* and 24*e* disposed in opposed relation with recesses 23*c* and 24*c*.

Male coupling assembly 12 generally consists of a collapsible linkage including a base frame section 29 pivotally connected at the lower ends thereof to the front ends of boom arms 13 and 14 and pivotally connected at the upper ends thereof to tilt linkages 15 and 16, and an extendable frame section 30 pivotally connected to base frame section 29. As best illustrated in FIGS. 1 and 3, base frame section 29 includes a lower, transversely disposed tubular member 31, a pair of side plate members 32 and 33 rigidly secured at the lower ends thereof to tubular member 31, inwardly of the transverse ends thereof, and an upper, transversely disposed member 34 rigidly interconnecting the upper ends of the side plate members. Rigidly mounted on upper and lower, transversely disposed members 34 and 31 is a pair of transversely spaced, rearwardly projecting bracket sets 35 and 36 for operatively connecting the base frame section to the boom arms and tilt linkages. As best seen in FIG. 3, the front ends of boom arms 13 and 14 are received within the lower ends of the bracket sets and are pivotally connected thereto by means of a pair of transversely aligned pins 37 and 38. Similarly, it will be seen that the forwardly disposed ends of connecting links 39 and 40 of the actuating linkages, are received within the upper ends of the bracket sets and pivotally connected thereto by means of a pair of a transversely aligned pins 41 and 42. It further will be seen that upon operation of tilt linkages 15 and 16, the base frame section will be caused to tilt or "roll" about the pivotal connection thereof with the forwardly disposed ends of boom arms 13 and 14.

Figure 6:
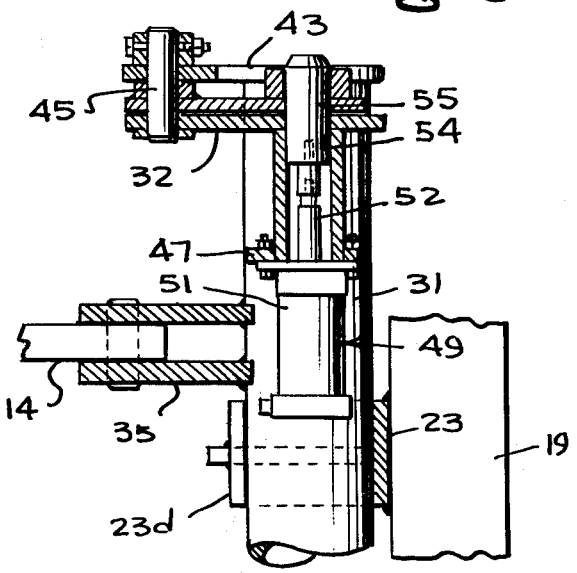
FIG. 6 is a cross-sectional view taken along line 6—6 in FIG. 5.

Mounted on the ends of tubular member 31 and extending upwardly and rearwardly along the lower rear edges of side plate members 32 and 33 is a pair of support arms 43 and 44. As best shown in FIGS. 3 and 6, support arm members 43 and 44 are spaced outwardly of side plate members 32 and 33. Disposed in suitable openings in support arm members 43 and 44 and adjacent side plate members 32 and 33 is a pair of transversely aligned pins 45 and 46 which support frame section 30 as will be described later.

Depending from and rigidly secured to the underside of upper, transversely disposed member 34 is a pair of brackets 47 and 48 which are spaced inwardly relative to side plate members 32 and 33, respectively. Brackets 47 and 48 cooperate with the side plate members of the base frame section to support a pair of transversely aligned piston and cylinder assemblies 49 and 50. Assembly 49 generally includes a cylinder 51 rigidly mounted on an outer end thereof on bracket 47 and a cooperating piston rod 52 extendable through an opening in bracket 47, a sleeve 53 rigidly connected to bracket 47 and side plate member 32, and an opening 54 in side plate member 32. As best shown in FIG. 6, piston rod 52 has an enlarged end portion 55 which is adapted to be inserted through opening 54 and project outwardly of side plate member 32 when piston rod 52 is in the extended position. It further will be appreciated that when piston rod 52 is in the retracted position, piston rod portion 55 will be retracted to a position within sleeve 53. Similarly, assembly 50 includes a cylinder 56 mounted on depending bracket 48, and a piston rod extendable through a sleeve 57 having an enlarged end portion 58 extendable through an opening in side plate member 33. Upon extension and retraction of the piston rod of assembly 50, enlarged piston rod portion 58 may be caused to extend through an opening in the side plate member and project laterally thereof and be retracted within sleeve 57. In the conventional manner, the cylinders of assemblies 49 and 50 are provided with suitable fluid supply lines which are connected to a suitable supply of fluid under pressure on the front end loader and appropriate control mechanisms on the loader adjacent the operator's work station which can be manipulated by the operator to selectively extend and retract the piston rods of the assemblies.

Figure 4:
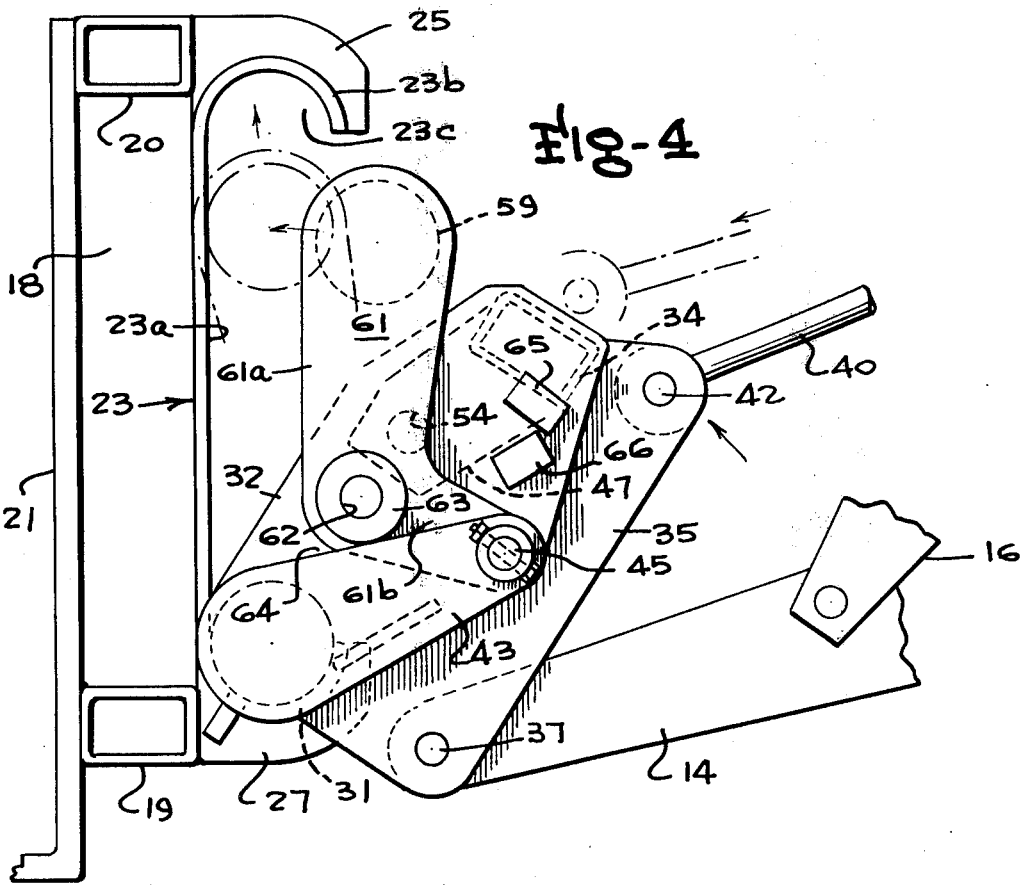
FIG. 4 is a view similar to the view of FIG. 2, illustrating the components in positions about to be coupled together.

Frame section 30 consists of a tubular member 59 disposed substantially parallel to tubular member 31 of base frame section 29, and a pair of L-shaped support arms 60 and 61 having arm portions 60*a* and 61*a* rigidly connected to the ends of tubular member 30 and arm portions 60*b* and 61*b* pivotally mounted on pins 46 and 45, respectively. As best illustrated in FIGS. 2 and 4, support member 61 is provided with an opening 62 which is registerable with opening 54 in side wall member 32 when arm member 61 is pivoted upwardly about pin 45. The angular displacement of arm 61 and, correspondingly, frame section 30, relative to frame section 29, is restricted by means of a boss 63 formed on the outer side of arm member 61, concentrically with opening 62, which engages a forwardly disposed edge 64 of support arm member 43 when arm member 61 is pivoted downwardly, and a pair of stop elements 65 and 66 mounted on the outer side of side plate member 32 which engage the rearward and upper edges of arm portions 61*a* and 61*b*, respectively, when arm member 61 is pivoted upwardly. Arm member 60 is formed and functions similarly to arm member 61, having an arm portion rigidly secured to an end of tubular member 59 and an arm portion pivotally mounted on pin 46. As best illustrated in FIG. 3, arm member 60 is provided with a boss 67 aligned transversely with boss 63 of arm member 61, which engages support arm member 44 to limit the downward pivotal movement of arm member 60, and stop elements 68 and 69, aligned transversely with stop elements 65 and 66, provided on side plate member 33 to restrict the upward pivotal movement of arm member 60.

To couple the male and female assemblies of the embodiment of the invention as described, the operator first maneuvers the loader so that it is positioned behind the attachment and in longitudinal alignment therewith so that boom arms 13 and 14 are positioned laterally relative to the lower ends of C-shaped members 23 and 24. The control system on the loader for the boom arms is then operated to lift the male assembly slightly so that it will clear lower hook portions 23*d* and 24*d* of C-shaped members 23 and 24, and the control system for linkages 15 and 16 is operated to tilt or "roll" the upper end of male assembly rearwardly. The loader is then moved forwardly toward the attachment until tubular member 31 engages the lower ends of intermediate portions 23*a* and 24*a* of the C-shaped members. The control system for the boom arms is then operated again to lower the front ends of the boom arms. As the boom arms are lowered, tubular member 31 will be received within recesses 23*e* and 24*e* of the C-shaped members and will be seated on hook portions 23*d* and 24*d*, as illustrated in FIG. 4. In the event the male assembly is not precisely longitudinally aligned with the C-shaped member of the female assembly, guide elements 71 and 72 rigidly mounted on and depending from tubular member 31, providing diverging guide edges, will guide tubular member 31 transversely onto hook portions 23*d* and 24*d*. With the male assembly in the position as illustrated in FIG. 4, the control system for linkages 15 and 16 is actuated to extend such linkages and cause the upper end of the male assembly to tilt forwardly about the axis of the pivotal connection of the male assembly with the boom arms and the axis of tubular member 31 seated in the lower ends of the C-shaped members. As the male assembly is thus rolled forwardly, frame section 30 will remain in a downwardly disposed position with bosses 63 and 67 thereof engaging support arm members 43 and 44 until tubular member 59 thereof engages the upper ends of intermediate portions 23*a* and 24*a* of the C-shaped members. Additional rolling motion of the male assembly will cause frame section 30 to pivot upwardly relative to base frame section 29 and tubular member 59 to ride upwardly into recesses 29*c* and 24*c* of the C-shaped members until arm members 60 and 61 of frame section 30 engage stop elements 65 and 66, and 68 and 69, respectively. Upon positioning tubular member 59 within recesses 23*c* and 24*c* and the engagement of arm members 60 and 61 with the stop elements provided on the base frame section, the male assembly will be in an extended, operative condition coupled with the female assembly on the attachment, with opening 62 of arm member 61 and the corresponding opening in arm member 60 being disposed in registry with opening 54 in side plate member 32 and a comparable opening in side plate member 33. Under such conditions, the male assembly may be locked in the extended, operative condition, in coupling relation with the female assembly, simply by actuating an appropriate control on the loader to supply fluid under pressure to the piston ends of cylinders 51 and 56 to extend the rods thereof through the openings in side plate members 32 and 33 and into the registered openings in arm members 60 and 61. The operator may then operate the controls for the boom arms and tilt linkages in the conventional manner to operate the working attachment.

Whenever it is desired to detach the working attachment and possibly attach a different working attachment, the boom arms are lowered to place the attachment on the ground, the controls for cylinder assemblies 49 and 50 are operated to retract the piston rods thereof thus unlocking the frame sections, the controls for the tilt linkages are operated to roll the male assembly rearwardly thus causing frame section 30 to pivot downwardly relative to frame section 29 so that tubular member 59 is removed from recesses 23*c* and 24*c* of the C-shaped members, clearing hook portions 23*b* and 24*b*, and bosses 63 and 67 are brought to rest on support arm members 43 and 44, as illustrated in FIG. 4. With the male assembly thus in a collapsed, inoperative condition, out of coupling relation with the female assembly, the controls for the boom arm are operated to lift the boom arms slightly upwardly so that tubular member 31 clears hook portions 23*d* and 24*d*, and the loader is backed off to clear the female assembly entirely. The male assembly is then in a condition to be moved to another working attachment provided with a female assembly 10 to be coupled therewith.

In the design of the system as described, the C-shaped members of the female assembly mounted on a working attachment should be spaced in a manner whereby they would not interfer with the connection of the male assembly with the boom arms when the system is in the coupled condition. In addition, the relationship of tubular members 31 and 59 both in the extended, operative condition as illustrated in FIG. 2 and the collapsed, inoperative condition as illustrated in FIG. 4, should be such so as to readily permit entry of such members into the C-shaped members and positioning thereof in the opposed recesses to provide a secure and sturdy coupling of the male and female assemblies.

The system as described can be formed of any suitable materials, utilizing any suitable fabrication methods. Since the system most likely would be used in heavy duty applications, it is preferred that the system be of a welded, steel construction.

From the foregoing detailed description, it will be evident that there are a number of changes, adaptations and modifications of the present invention which come within the province of those skilled in the art. However, it is intended that all such variations not departing from the spirit of the invention be considered as within the scope thereof as limited solely by the appended claims.

We claim:

1. A system for detachably coupling an attachment to a prime mover provided with a pair of boom arms and an actuating linkage movable independently of said boom arms comprising a pair of transversely aligned, C-shaped members rigidly mounted on said attachment, a first frame section pivotally mountable on said boom arms of said prime mover, said first frame section including a pair of transversely spaced side plate members, a transversely disposed cylindrical member interconnecting the lower ends of said side plate member, receivable within transversely aligned lower ends of said C-shaped members mounted on said attachment, and a transversely disposed member rigidly interconnecting the upper ends of said side plate members, said first frame section having a pair of transversely spaced, rearwardly projecting brackets secured to said upper end and lower transversely disposed members thereof, the lower ends of said brackets having means for pivotally connecting said first frame section to said boom arms, a second frame section including a pair of L-shaped side arm members and a transversely disposed cylindrical member receivable within transversely aligned upper ends of said C-shaped members mounted on said attachment, said side arm members of said second frame section each having an L-shaped configuration including an arm portion pivotally connected to an adjacent side plate member of said first frame section and a second arm portion supporting said transversely disposed cylindrical member, each of said side plate members having an opening registerable with an opening in an adjacent side arm member when said transversely disposed cylindrical members are received within the upper and lower ends of said C-shaped members, a piston and cylinder assembly mounted on said first frame section adjacent each side plate member thereof, having a piston rod thereof extendable through said openings, when in registry, for locking said second frame section relative to said first frame section when said transversely disposed cylindrical members are received within the upper ends of said C-shaped members and said first and second frame are thus coupled to said attachment, and means mounted on the upper ends of said brackets for pivotally connecting the upper end of said first frame section to said actuating linkage whereby upon positioning said transversely disposed cylindrical member of said first frame section in the transversely aligned, lower ends of said C-shaped members, said actuating linkage may be operated to pivot said first and second frame sections forwardly about the pivotal connection between said boom arms and said first frame section so that said transversely disposed cylindrical member of said second frame section will be caused to engage intermediate portions of said C-shape members and ride upwardly into the upper, transversely aligned portions of said C-shaped members thus permiting said piston rods to be extended though aligned openings in said side plate members and side arm members to lock said frame sections together and corresponding rigidly couple said first and second frame sections to said attachment.

2. A system for detachably coupling an attachment to a prime mover provided with a mounting means and an actuating means comprising a female device mountable on said attachment and a collapsible male assembly mountable on said mounting means on said prime mover, cooperatively engagable with said female device, said male assembly being operatively connectable to said actuating means and movable thereby between a collapsed, inoperative condition and an extended, operative condition operatively engageable with said female device in coupling relation when said male assembly is positioned adjacent said female device in registry therewith, the male assembly comprising a collapsible mechanical linkage including components cooperatively engagable with said female device in coupling relation when the male assembly is in said extended, operative condition, and means mounted on said male assembly for selectively locking said collapsible linkage in said extended, operative condition including a fluid actuating piston and cylinder assembly mounted on a component of said collapsible linkage and having a piston thereof adapted to extend and be inserted through a pair of registered openings in a pair of components of said collapsible linkage when said collapsible linkage is in the extended, operative condition.

3. A system for detachably coupling an attachment to a prime mover provided with a mounting means and an actuating means comprising a female device mountable on said attachment and a collapsible male assembly mountable on said mounting means of said prime mover, cooperatively engagable with said female device, said male assembly being operatively connectable to said actuating means and movable thereby between a collapsed, inoperative condition and an extended, operative condition operatively engagable with said female device in coupling relation when said male assembly is positioned adjacent said female device in registry therewith, the male assembly comprising a collapsible, mechanical linkage including a first link operatively connectable to said mounting means of said prime mover, including a component cooperatively engagable with said female device when said collapsible linkage is in said extended, operative condition, and a second link pivotally connected to said first link, including a component cooperatively engagable with said female device when said collapsible linkage is in said extended, operative condition, and means mounted on said male assembly for selectively locking said collapsible linkage in said extended, operative condition comprising at least one fluid actuated piston and cylinder assembly having the piston thereof adapted to extend and be inserted through a pair of openings of said first and second links adapted to register when said collapsible linkage is in the extended, operative condition.

4. A system for detachably coupling an attachment to a prime mover provided with a mounting means and an actuating means comprising a female device mountable on said attachment and a collapsible male assembly mountable on said mounting means of said prime mover, cooperatively engagable with said female device, said male assembly being operatively connectable to said actuating means and movable thereby between a collapsed, inoperative condition and an extended, operative condition operatively engagable with said female device in coupling relation when said male assembly is positioned adjacent said female device in registry therewith, the male assembly comprising a collapsible mechanical linkage including a first link operatively connectable to said mounting means of said prime mover, including a component cooperatively engagable with said female device when said collapsible linkage is in said extended, operative condition, and a second link pivotally connected to said first link, including a component cooperatively engagable with said female device when said collapsible linkage is in said extended, operative condition, a lower end of said first link being pivotally connected to a pair of boom arms of said prime mover, said second link being pivotally connected to said first link at a point between the pivotal connection of said first link to said boom arm and an upper free end thereof, and said first link being operatively connectable to said actuating means at a point between the pivotal connection between said first and second links and said free end of said first link, and means mounted on said male assembly for selectively locking said male assembly in said extended, operative condition.

5. A system according to claim 4, wherein said second link has an L-shaped configuration, having one arm portion thereof pivotally connected to said first link of said collapsible linkage and the other arm portion thereof supporting said component cooperatively engagable with said female device when said collapsible linkage is in said extended, operative condition.

6. A system according to claim 4, wherein said component of said first link of said collapsible linkage, cooperatively engagable with said female device when said collapsible linkage is in said extended, operative condition, is disposed on said first link at a point between the pivotal connection of said first and second links and an end of said first link opposite the free end thereof.

7. A system for detachably coupling an attachment to a prime mover provided with a mounting means and an actuating means comprising a female device mountable on said attachment and a collapsible male assembly mountable on said mounting means of said prime mover, cooperatively engagable with said female device, said male assembly being operatively connectable to said actuating means and movable thereby between a collapsed, inoperative condition and an extended, operative condition operatively engagable with said female device in coupling relation when said male assembly is positioned adjacent said female device in registry therewith, the male assembly comprising a first frame section pivotally mountable on a pair of boom arms on said prime mover, and a second frame section pivotally connected to said first frame section, said first frame section including a pair of transversely spaced, side plate members, an upper, transversely disposed member rigidly interconnecting the upper ends of said side plate members and a lower, transversely disposed member rigidly interconnecting the lower ends of said side plate members and being cooperatively engagable with said female device, said first frame section having means for pivotally connecting said first frame section to said boom arms, said second frame member having a pair of arm members each pivotally connected to a side plate member of said first frame section, and a transversely disposed component rigidly interconnecting said side arm members and being cooperatively engagable with said female device when said male assembly is in said extended, operative condition, and wherein an upper end of said first frame section is operatively connectable to said actuating means of said prime mover whereby upon actuation of said actuating means said first frame section will be caused to pivot relative to said boom arms, said female device providing a pair of opposed recesses, and said lower, transversely disposed member of said first frame section and said transversely disposed member of said second frame section being received within said recesses when said male assembly is disposed adjacent said female device, with the components of said male assembly disposed in registry with said recesses and said male assembly is in said extended, operative condition, and means mounted on said male assembly for selectively locking said male assembly in said extended, operative condition.

8. A system according to claim 7, wherein said female device includes at least one vertically disposed, C-shaped member providing said opposed recesses.

9. A system according to claim 8, wherein said lower, transversely disposed member of said first frame section and said transversely disposed member of said second frame section, engagable with said female device, has cylindrical configurations.

10. A system for detachably coupling an attachment to a prime mover provided with a mounting means and an actuating means comprising a female device mountable on said attachment and a collapsible male assembly mountable on said mounting means of said prime mover, cooperatively engagable with said female device, said male assembly being operatively connectable to said actuating means and movable thereby between a collapsed, inoperative condition and an extended, operative condition operatively engagable with said female device in coupling relation when said male assembly is positioned adjacent said female device in registry therewith, and means mounted on said male assembly for selectively locking said male assembly in said extended, operative condition, the male assembly comprising a first frame section pivotally mountable on a pair of boom arms on said prime mover, and a second frame section pivotally connected to said first frame section, said first frame section including a pair of transversely spaced, side plate members, an upper, transversely disposed member rigidly interconnecting the upper ends of said side plate members and a lower, transversely disposed member rigidly interconnecting the lower ends of said side plate members and being cooperatively engagable with said female device, said first frame section having means for pivotally connecting said first frame section to said boom arms, said second frame member having a pair of arm members each pivotally connected to a side plate member of said first frame section and a transversely disposed component rigidly interconnecting said side arm members and being cooperatively engagable with said female device when said male assembly is in said extended operative condition, and wherein an upper end of said first frame section is operatively interconnectable to said actuating means of said prime mover whereby upon actuation of said actuating means said first frame section will be caused to pivot relative to said boom arms, and a means for selectively locking said male assembly in said extended, opertive condition comprising at least one piston and cylinder assembly mounted on said first frame section having a piston extendable into a pair of openings in the side plate member of said first frame section and a side arm member of said second frame section, registrable when said male assembly is in said extended, operative condition.

11. A system for detachably coupling a attachment to a prime mover provided with a mounting means and an actuating means comprising a female device mountable on said attachment and a collapsible male assembly mountable on said mounting means of said prime mover, cooperatively engagable with said female device, said male assembly being operatively connectable to said actuating means and movable thereby between a collapsed, inoperative condition and an extended, operative condition operatively engagable with said female device in coupling relation when said male assembly is positioned adjacent said female device in registry therewith, and means mounted on said male assembly for selectively locking said male assembly in said extended, operative condition, the male assembly comprising a first frame section pivotally mountable on a pair of boom arms on said prime mover, and a second frame section pivotally connected to said first frame section, said first frame section including a pair of transversely spaced, side plate members, an upper, transversely disposed member rigidly interconnecting the upper ends of said side plate members and a lower, transversely disposed member rigidly interconnecting the lower ends of said side plate members and being cooperatively engagable with said female device, said first frame section having means for pivotally connecting said first frame section to said boom arms, said second frame member having a pair of arm members each pivotally connected to a side plate member of said first frame section at points intermediate the pivotal connection between said first frame section and said boom arms and the operative connection of said first frame section and said actuating means, and a transversely disposed component rigidly interconnecting said side arm members and being cooperatively engagable with said female device when said male assembly is in said extended, operative condition, and wherein an upper end of said first frame section is operatively connectable to said actuating means of said prime mover, whereby upon actuation of said actuating means said first frame section will be caused to pivot relative to said boom arms.

12. A system for detachably coupling an attachment to a prime mover provided with a mounting means and an actuating means comprising a female device mountable on said attachment and a collapsible male assembly mountable on said mounting means of said prime mover, cooperatively engagable with said femle device, said male assembly being operatively connectable to said actuating means and movable thereby between a collapsed, inoperative condition and an extended, operative condition operatively engagable with said female device in couplng relation when said male assembly is positioned adjacent said female device in registry therewith, and means mounted on said male assembly for selectively locking said male assembly in said extended, operative condition, the male assembly comprising a first frame section pivotally mountable on a pair of boom arms on said prime mover, and a second frame section pivotally connected to said first frame section, said first frame section including a pair of transversely spaced, side plate members, an upper, transversely disposed member rigidly interconnecting the upper ends of said side plate members and a lower, transversely disposed member rigidly interconnecting the lower ends of said side plate members and being cooperatively engagable with said female device, said first frame section having means for pivotally connecting said first frame section to said boom arms, said second frame section having a pair of arm members each pivotally connected to a side plate member of said first frame section, and a transversely disposed component rigidly interconnecting said side arm members and being cooperatively engagable with said female device when said male assembly is in said extended, operative condition, and wherein an upper end of said first frame section is operatively connectable to said actuating means of said prime mover whereby upon actuation of said actuating means said first frame section will be caused to pivot relative to said boom arms, and means for restricting the angular displacement of said second frame section relative to said first frame section within predetermined limits.

13. A system according to claim 12, wherein said limiting means comprise stop elements mounted on said first frame section engagable by said second frame section.

14. A system for detachably coupling an attachment to a prime mover provided with a mounting means and an actuating means comprising a female device mountable on said attachment and a collapsible male assembly mountable on said mounting means on said prime mover, cooperatively engagable with said female device, said male assembly being operatively connectable to said actuating means and movable thereby between a collapsed, inoperative condition and an extended, operative condition operatively engagable with said female device in coupling relation when said male assembly is positioned adjacent said female device in registry therewith, and means mounted on said male assembly for selectively locking said male assembly in said extended, operative condition, the male assembly comprising a first frame section pivotally mountable on a pair of boom arms on said prime mover, and a second section pivotally connected to said first frame section, said first frame section including a pair of transversely spaced, side plate members, an upper transversely disposed member rigidly interconnecting the upper ends of said side plate members and a lower, transversely disposed member rigidly interconnecting the lower ends of said side plate members and being cooperatively engagable with said female device, said first frame section having means for pivotally connecting said first frame section to said boom arms, said second frame member having a pair of arm members each pivotally connected to a side plate member of said first frame section, each of said side arm members of said second frame section having an L-shaped configuration wherein a first arm portion thereof is pivotally connected to said first frame section and said transversely disposed member of said second frame section is secured to the other arm portion thereof, and a transversely disposed component rigidly interconnecting said side arm members and being cooperatively engagable with said female device when said male assembly is in said extended, operative condition, and wherein an upper end of said first frame section is operatively connectable to said actuating means of said prime mover whereby upon actuation of said actuating means said first frame section will be caused to pivot relative to said boom arms.

15. An apparatus for detachably coupling an attachment provided with a female device to a prime mover provided with a mounting means and an actuating means comprising a collapsible male assembly mountable on said mounting means of said prime mover assembly and further comprising a collapsible mechanical linkage including components cooperatively engagable with said female device in coupling relation, said male assembly being operatively engagable with said actuating means and movable thereby between a collapsed, inoperative condition and an extended, operative condition operatively engagable with said female device in coupling relation when said male assembly is positioned adjacent said female device in registry therewith, and means mounted on said male assembly for selectively locking said male assembly in said extended, operative condition, the male assembly including a first frame section pivotally connectable at a lower end thereof to a pair of boom arms of said prime mover, having a transversely disposed member engagable with a lower end of said female device, and operatively connectable at an upper end thereof to said actuating means, and a second frame section pivotally connected to said first frame section and including a transversely disposed member cooperatively engagable with an upper end of said female device when said actuating means is operated to pivot said first frame section relative to said boom arms and said second frame section engages said female device and is caused to pivot relative to said first frame section.

* * * * *